US009127630B2

(12) United States Patent
Ishiki et al.

(10) Patent No.: US 9,127,630 B2
(45) Date of Patent: Sep. 8, 2015

(54) FUEL SUPPLY APPARATUS FOR ENGINE

(71) Applicant: HONDA MOTOR CO., LTD., Tokyo (JP)

(72) Inventors: Kazuya Ishiki, Wako (JP); Kazuaki Naramoto, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 374 days.

(21) Appl. No.: 13/658,824

(22) Filed: Oct. 24, 2012

(65) Prior Publication Data

US 2013/0133622 A1 May 30, 2013

(30) Foreign Application Priority Data

Nov. 25, 2011 (JP) ..... 2011-257617

(51) Int. Cl.

| | |
|---|---|
| ***F02M 69/46*** | (2006.01) |
| ***F02M 55/02*** | (2006.01) |
| ***F02M 55/00*** | (2006.01) |
| ***F02M 63/02*** | (2006.01) |

(52) U.S. Cl.

CPC ..... *F02M 55/02* (2013.01); *F02M 55/004* (2013.01); *F02M 55/025* (2013.01); *F02M 63/0225* (2013.01)

(58) Field of Classification Search

CPC ..... F02B 55/02; F02D 1/00; F02D 9/00; F02D 2250/00; F02M 55/02; F02M 55/04; F02M 69/462

USPC ..... 123/54.4, 299, 305, 447, 456, 467–470

See application file for complete search history.

(56) References Cited

U.S. PATENT DOCUMENTS

| | | | | |
|---|---|---|---|---|
| 3,507,263 | A * | 4/1970 | Long | 123/455 |
| 5,433,182 | A * | 7/1995 | Augustin et al. | 123/456 |
| 5,577,479 | A * | 11/1996 | Popp | 123/458 |

(Continued)

FOREIGN PATENT DOCUMENTS

| | | |
|---|---|---|
| JP | 2003-278624 | 10/2003 |
| JP | 2004-132231 | 4/2004 |

(Continued)

OTHER PUBLICATIONS

Japanese Office Action for corresponding JP Application No. 2011-257617, Sep. 30, 2013.

(Continued)

*Primary Examiner* — John Kwon
*Assistant Examiner* — Johnny H Hoang
(74) *Attorney, Agent, or Firm* — Mori & Ward, LLP

(57) ABSTRACT

A fuel supply apparatus for an engine, includes a first cylinder group, a second cylinder group, first fuel injection valves, second fuel injection valves, a fuel supply pipe, a branch portion, a first connecting pipe, a second connecting pipe, a first delivery pipe, and a second delivery pipe. The branch portion has an inflow direction along which fuel is to flow from the fuel supply pipe into the branch portion. The branch portion has a first outflow direction along which fuel is to flow from the branch portion into the first connecting pipe. The branch portion has a second outflow direction along which fuel is to flow from the branch portion into the second connecting pipe. All of the inflow direction, the first outflow direction, and the second outflow direction are provided not to lie in a same straight line.

20 Claims, 7 Drawing Sheets

(56) References Cited

U.S. PATENT DOCUMENTS

| | | | | |
|---|---|---|---|---|
| 6,135,092 | A * | 10/2000 | Schaenzer et al. | 123/456 |
| 7,789,071 | B2 * | 9/2010 | Akita et al. | 123/447 |
| 7,980,225 | B2 * | 7/2011 | Yamanari | 123/447 |
| 8,297,257 | B2 * | 10/2012 | Sugiyama et al. | 123/456 |
| 2004/0069277 | A1 * | 4/2004 | Mizuno et al. | 123/456 |
| 2004/0144368 | A1 * | 7/2004 | Serizawa et al. | 123/456 |
| 2007/0144482 | A1 * | 6/2007 | Kojima et al. | 123/299 |
| 2009/0159049 | A1 * | 6/2009 | Sakagami et al. | 123/456 |

FOREIGN PATENT DOCUMENTS

| | | |
|---|---|---|
| JP | 2007-16650 | 1/2007 |
| JP | 2008-075470 | 4/2008 |
| JP | 2009-209803 | 9/2009 |

OTHER PUBLICATIONS

Chinese Office Action for corresponding CN Application No. 201210372292.2, Jul. 3, 2014.

* cited by examiner

FUEL SUPPLY APPARATUS FOR ENGINE

CROSS-REFERENCE TO RELATED APPLICATIONS

The present application claims priority under 35 U.S.C. §119 to Japanese Patent Application No. 2011-257617, filed Nov. 25, 2011, entitled "Fuel Supply Apparatus For Engine." The contents of this application are incorporated herein by reference in their entirety.

BACKGROUND OF THE INVENTION

1. Field of the Invention

The present application relates to a fuel supply apparatus for an engine.

2. Discussion of the Background

In the related art, there are engines having a fuel injection valve installed on each cylinder of a multi-cylinder engine. For example, in some V-type engines or horizontally opposed engines, two rows of cylinders are provided, and a single fuel supply passage from a fuel tank (fuel pump) branches out to each of delivery pipes extending in the direction of the corresponding cylinder row (see, for example, Japanese Unexamined Patent Application No. 2004-132231).

In engines with a fuel injection valve installed on each cylinder, injection of fuel produces a pressure pulsation in each delivery pipe. Further, in the case of engines having a pair of cylinder rows such as V-type engines or horizontally opposed engines, the pressure pulsation may induce vehicle vibration or noise, or may lead to deterioration of fuel economy or emission increases due to unstable combustion resulting from inability to obtain a desired pressure for the fuel in the fuel supply pipe.

In Japanese Unexamined Patent Application No. 2004-132231 mentioned above, a pair of connecting pipes each connected to the corresponding delivery pipe are connected to a single fuel supply pipe connected to the fuel pump, in a T-shaped configuration. The pair of connecting pipes extend in opposite directions coaxially in the same straight line. Such a piping structure has a problem in that the pressure pulsation is amplified along the axial direction of the pair of connecting pipes.

In the case of V-type engines, in particular, the direction of vibration differs between the two cylinder rows. Accordingly, the impact of vibration on the delivery pipes, the connecting pipes, and the fuel supply pipe, and also the connecting portion between the fuel supply pipe and each connecting pipe needs to be taken into consideration.

SUMMARY OF THE INVENTION

According to one aspect of the present invention, a fuel supply apparatus for an engine, includes a first cylinder group, a second cylinder group, first fuel injection valves, second fuel injection valves, a fuel supply pipe, a branch portion, a first connecting pipe, a second connecting pipe, a first delivery pipe, and a second delivery pipe. The first cylinder group includes a plurality of cylinders. The second cylinder group includes a plurality of cylinders. The first fuel injection valves are to inject fuel to the cylinders of the first cylinder group. The second fuel injection valves are to inject fuel to the cylinders of the second cylinder group. The fuel supply pipe is connected to a fuel supply source. The branch portion is connected to the fuel supply pipe and has an inflow direction along which fuel is to flow from the fuel supply pipe into the branch portion. The first connecting pipe is connected to the branch portion. The branch portion has a first outflow direction along which fuel is to flow from the branch portion into the first connecting pipe. The second connecting pipe is connected to the branch portion. The branch portion has a second outflow direction along which fuel is to flow from the branch portion into the second connecting pipe. All of the inflow direction, the first outflow direction, and the second outflow direction are provided not to lie in a same straight line. The first delivery pipe is connected to the first connecting pipe to deliver fuel via the first fuel injection valves to the cylinders of the first cylinder group. The second delivery pipe is connected to the second connecting pipe to deliver fuel via the second fuel injection valves to the cylinders of the second cylinder group.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

FIGS. 7A and 7B illustrate stress exerted on a connecting pipe with respect to engine speed, of which FIG. 7A illustrates a connection according to the related art, and FIG. 7B illustrates the present application.

DESCRIPTION OF THE EMBODIMENTS

Figure 1:
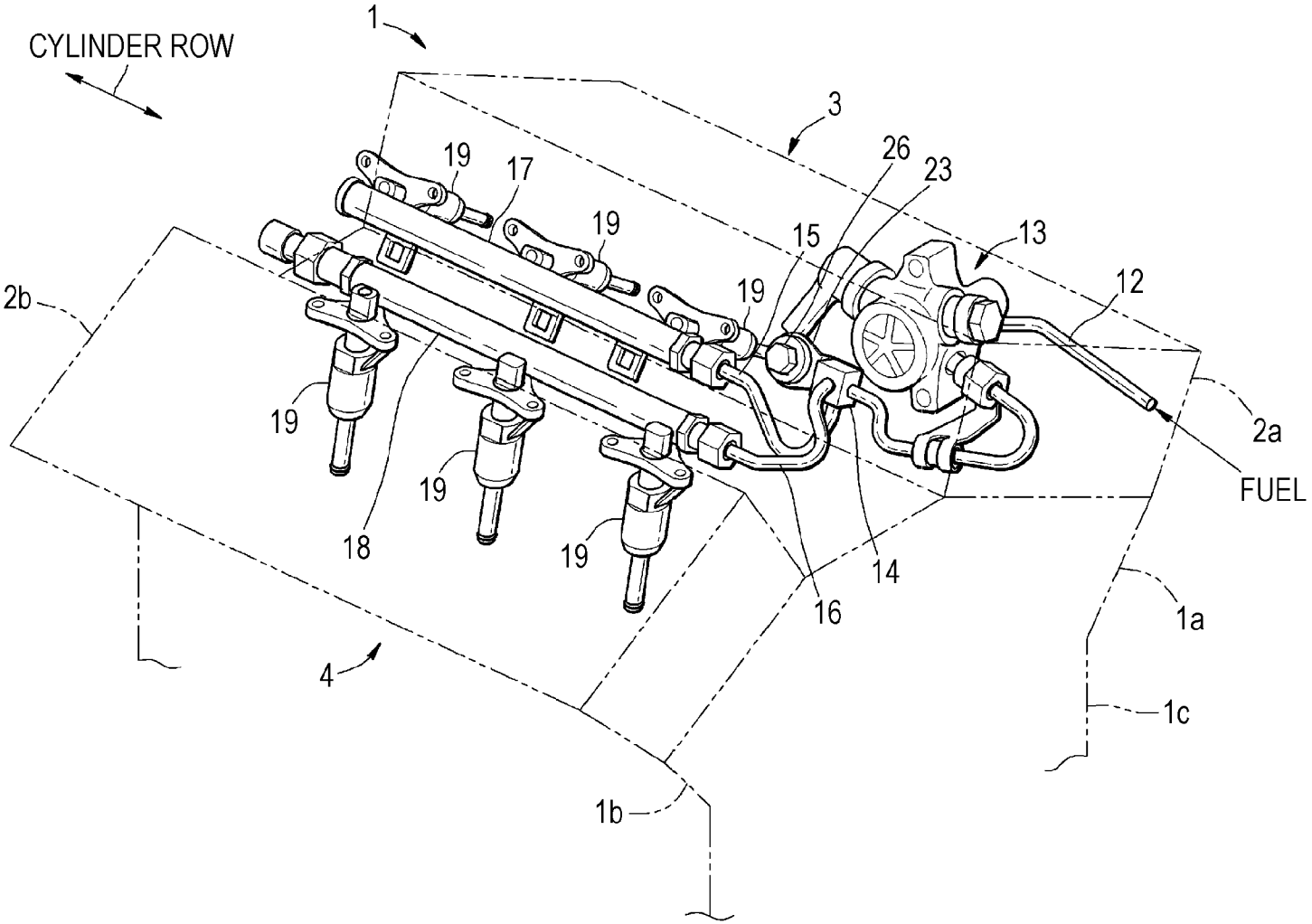
FIG. 1 is a perspective view of the main portion of a fuel supply apparatus for a V-type engine according to the embodiment.

The embodiments will now be described with reference to the accompanying drawings, wherein like reference numerals designate corresponding or identical elements throughout the various drawings.

FIG. 1 is a perspective view of the main portion of a fuel supply apparatus for a V-type engine 1 according to the present application.

As illustrated in FIG. 1, the engine 1 has a cylinder block 1*c*, and cylinder heads 2*a*, 2*b*. The cylinder block 1*c* is formed in a V-shaped configuration by a first cylinder bank 1*a* and a second cylinder bank 1*b* that tilt in such a way as to diverge to the opposite sides (e.g., in the front-back direction of the vehicle). The cylinder heads 2*a*, 2*b* are provided over the cylinder banks 1*a*, 1*b*, respectively. A head cover (not illustrated) is provided over each of the cylinder heads 2*a*, 2*b*. An intake device (not illustrated) of the engine 1 is installed inside the two cylinder banks 1*a*, 1*b*, and an exhaust system is installed outside the two cylinder banks 1*a*, 1*b*.

In the example illustrated in FIG. 1, the engine 1 is a V-type, 6-cylinder engine, with three cylinders being provided in series in each of the cylinder banks 1*a*, 1*b*. In the following description, each set of these three cylinders is defined as a cylinder group, the three cylinders on one cylinder bank 1*a* side is defined as a first cylinder group 3, and the three cylinders on the other cylinder bank 1*b* side is defined as a second cylinder group 4.

Figure 2:
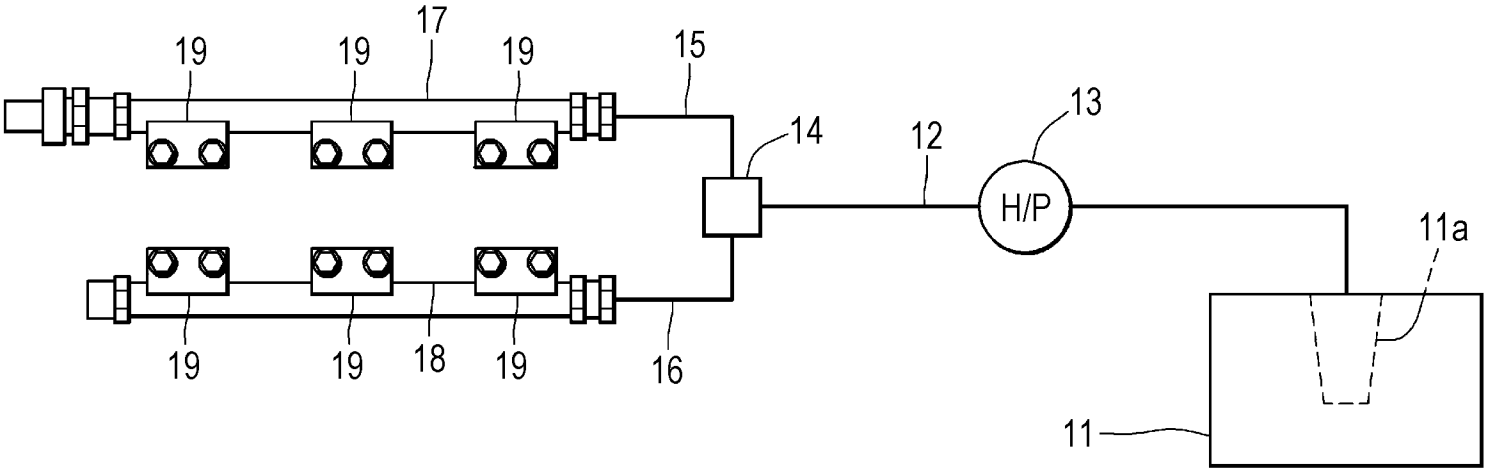
FIG. 2 is a schematic diagram illustrating the general configuration of the fuel supply apparatus.

As also illustrated in FIG. 2, the fuel supply apparatus according to the present application has a fuel tank 11, a fuel pump 11*a*, a fuel supply pipe 12, a high pressure fuel pump 13, a joint member 14, two connecting pipes 15, 16, a first delivery pipe 17, a second delivery pipe 18, and multiple fuel injection valves 19. The fuel pump 11*a* is provided inside the fuel tank 11. One end of the fuel supply pipe 12 is connected to the fuel tank 11 (fuel pump 11*a*). The high pressure fuel pump 13 is provided in the intermediate portion of the fuel supply pipe 12 and installed on the engine 1 side. The joint member 14 has a branch portion to which the other end of the fuel supply pipe 12 is connected. One end of each of the connecting pipes 15, 16 is connected to the joint member 14. The first delivery pipe 17 is connected to the connecting pipe 15 and corresponds to the first cylinder group 3. The second delivery pipe 18 is connected to the other connecting pipe 16 and corresponds to the second cylinder group 4. Each of the delivery pipes 17, 18 is provided with three fuel injection valves 19 to inject fuel to individual cylinders. The fuel tank 11 (fuel pump 11*a*) and the high pressure fuel pump 13 form a fuel supply source.

The three fuel injection valves 19 provided to the first delivery pipe 17 correspond to first to third cylinders, and the three fuel injection valves 19 provided to the second delivery pipe 18 correspond to fourth to fifth cylinders. In the fuel supply apparatus according to the present application, fuel in the fuel tank 11 is raised to a predetermined pressure by the high pressure fuel pump 13, delivered to the delivery pipes 17, 18 via the joint member 14, and injected from the fuel injection valves 19 to individual cylinders at fuel injection timing suited to the driving condition. The high pressure fuel pump 13 may be of a positive displacement type.

Next, the joint member 14 will be described with reference to FIGS. 3A to 5. The joint member 14 is formed in the shape of a rectangular parallelepiped block with six faces as a whole. The shape of the joint member 14 may not necessarily be a polyhedron including a rectangular parallelepiped but may be a sphere.

Three faces 14*a* to 14*c* of the joint member 14 are provided with cylindrical bosses 14*d* to 14*f*, respectively. The cylindrical bosses 14*d* to 14*f* protrude in the directions of three axes that are orthogonal to each other. The bosses 14*d* to 14*f* are coaxially provided with first to third connecting ports P1 to P3, respectively. The first connecting port P1 is connected with the fuel supply pipe 12. The second and third connecting ports P2, P3 are connected with the connecting pipes 15, 16, respectively. Also, the connecting ports P1 to P3 communicate with each other via a branch chamber 21 that is defined in the portion of the intersection of the above-mentioned three axes inside the joint member 14. The connecting ports P1 to P3 and the branch member 21 form a branch portion. The three connecting ports P1 to P3 are formed as channels that extend in different directions that are three-dimensionally orthogonal to each other. The pipes 12, 15, 16 may be connected to the respective connecting ports P1 to P3 by welding.

The joint member 14 has an orifice 22 provided between the first connecting port P1 and the branch chamber 21. The orifice 22 is smaller in diameter than the connecting ports P1 to P3. The second and third connecting ports P2, P3 communicate with the first connecting port P1 via the orifice 22.

Figure 4:
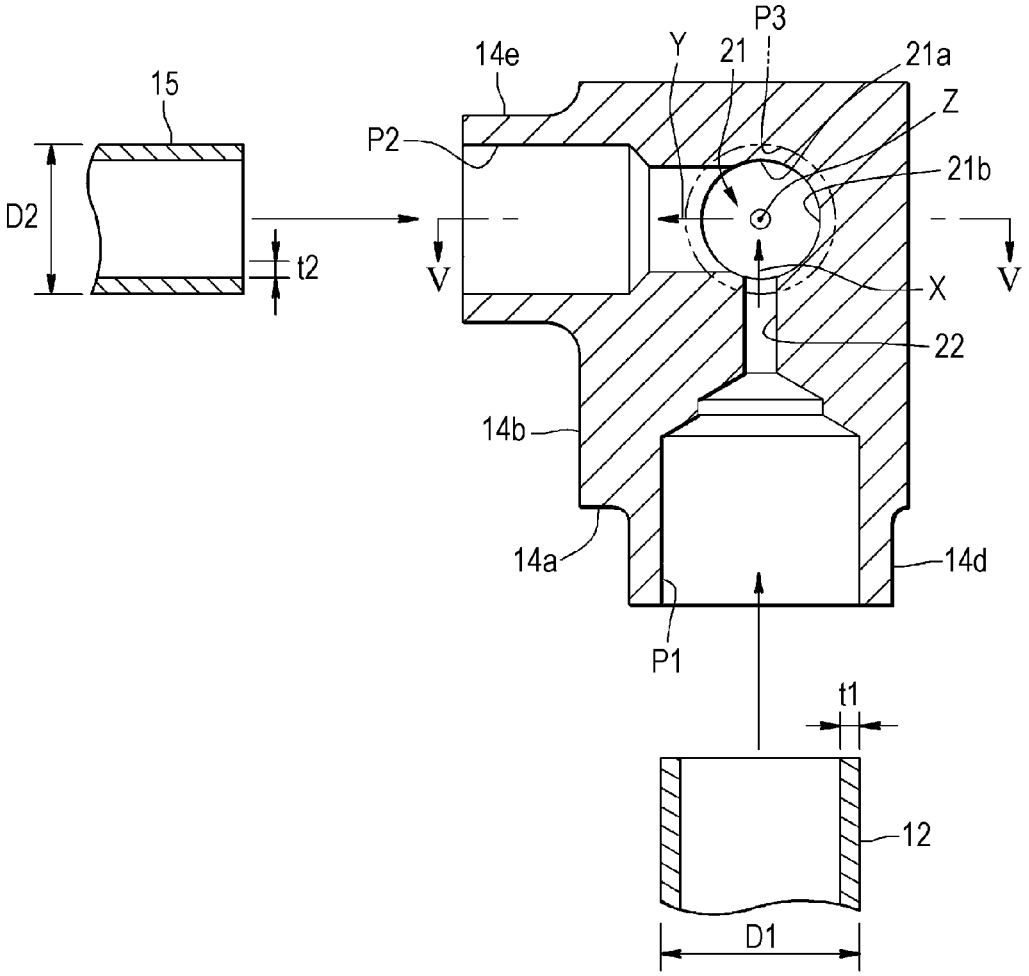
FIG. 4 is a sectional view taken along arrows IV-IV in FIG. 3B.
Figure 5:
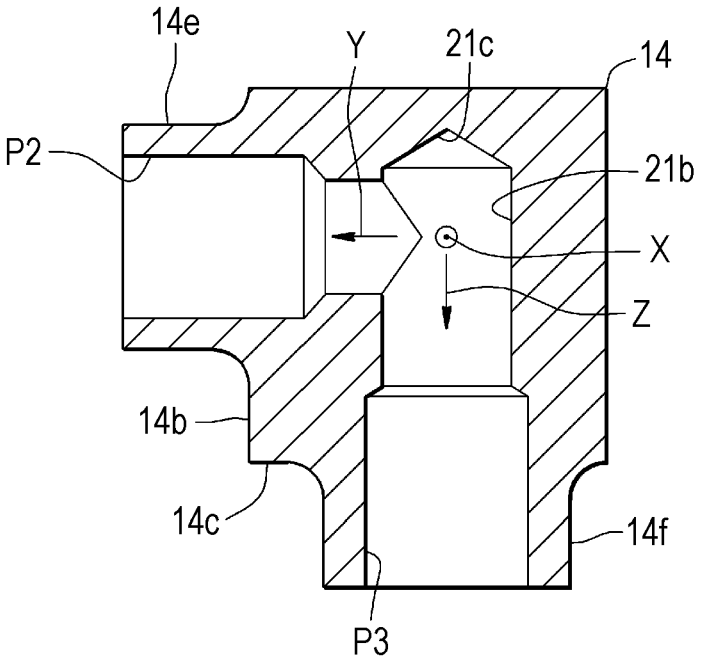
FIG. 5 is a sectional view taken along arrows V-V in FIG. 4.

Fuel supplied from the fuel supply pipe 12 flows in along the X-direction illustrated in FIG. 4, and passes through the orifice 22 and enters the branch chamber 21. The fuel is then caused to flow out from the branch chamber 21 separately to the second connecting port P2 and the third connecting port P3. The outflow direction to the second connecting port P2 (Y-direction in FIG. 4), and the outflow direction to the third connecting port P3 (Z-direction in FIG. 4) are orthogonal to one another, and are also each orthogonal to the above-mentioned inflow direction (X-direction). In this way, all of the inflow direction and the two outflow directions do not lie in the same straight line.

In the branch member 21, the portion opposed to the first port P1 is a first opposed face 21*a*, the portion opposed to the second port P2 is a second opposed face 21*b*, and the portion opposed to the third port P3 is a third opposed face 21*c*.

Since fuel is injected intermittently, when a pulsation of fuel pressure occurs in each of the connecting pipes 15, 16, the pressure pulsation propagates to the branch chamber 21. For example, in the case of piping arrangement in which the two connecting pipes branch off from the fuel supply pipe in a T-shaped configuration, the two connecting pipes extend in the same straight line. Therefore, there is a risk that a pressure pulsation occurring in one of the connecting pipes easily travels to the other connecting pipe, causing the pressure pulsation to be amplified.

In this regard, as mentioned above, in the branch chamber 21, the axes of the connecting ports P1 to P3 extend three-dimensionally orthogonal to each other in the X-, Y-, and Z-directions. As a result, for example, when a pressure pulsation in the connecting pipe 15 enters the branch chamber 21, the pressure pulsation is not amplified because there is no channel that lies in the same straight line with respect to the direction of travel of the pressure pulsation. Since the same applies for the other pipes 12, 16, a repetitive description is omitted. Further, in the branch chamber 21, pressure pulsations occurring in the pipes 12, 15, 16 are absorbed by the opposed faces 21*a* to 21*c* opposed to the ports P1, P2, P3, respectively, and hence further reduced.

As mentioned above, the orifice 22 is provided between the first port P1 located in the outflow direction of fuel from the fuel supply pipe 12, and the branch chamber 21. Therefore, even when a pressure pulsation occurs in the fuel supply pipe 12, the flow of fuel going toward the branch chamber 21 is throttled down in the orifice 22, thereby reducing the pressure pulsation. A pressure pulsation due to the high pressure fuel pump 13 is always present in the fuel supply pipe 12, and this pressure pulsation can be effectively reduced.

The joint member 14 is mounted on the outer wall of the cylinder head 2*a* on the cylinder group 3 side via a stay 23. The stay 23 is formed by bending a metal plate. One end of the stay 23 is secured along one face of the joint member 14, and the other end is screwed onto the outer wall of the cylinder head 2*a*.

Figure 3A:
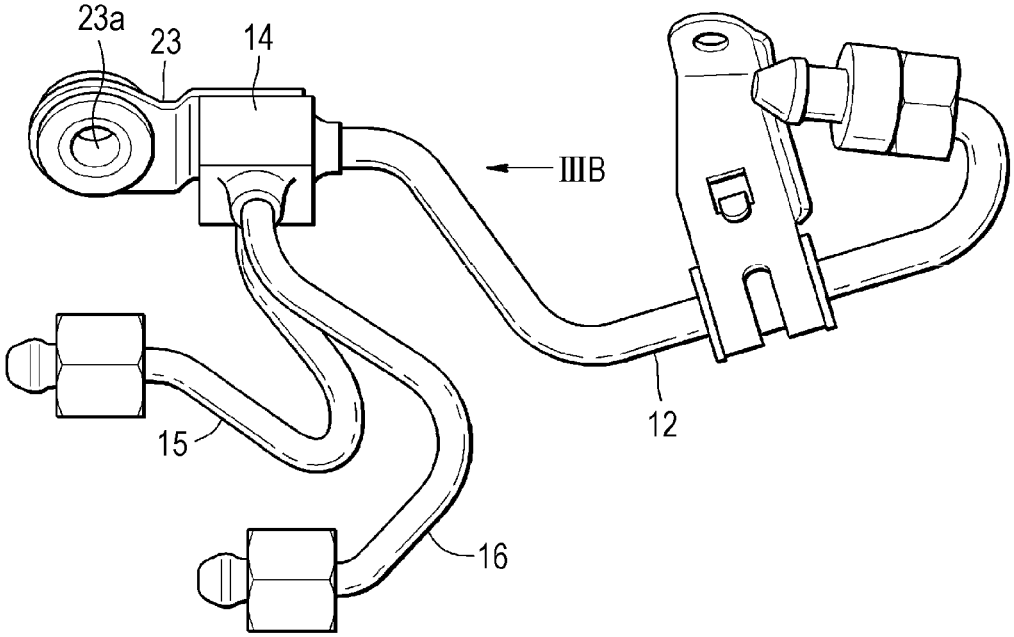
FIGS. 3A and 3B are a perspective view of a joint member, and a main-portion end view as seen along an arrow IIIB in FIG. 3A, respectively.
Figure 3B:
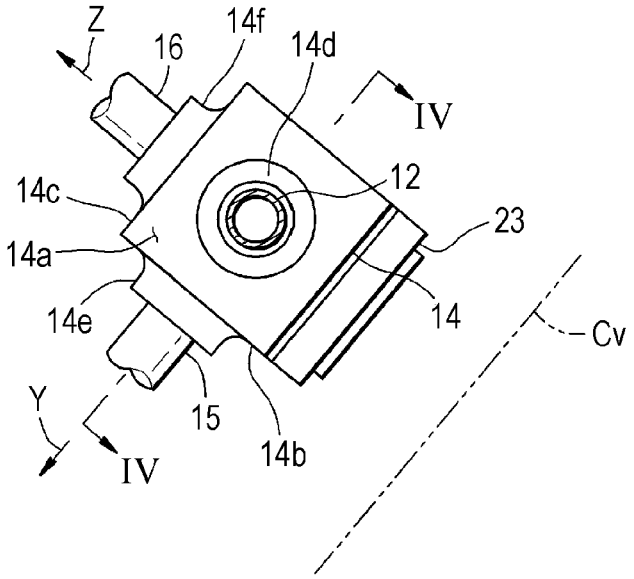
Figure 6:
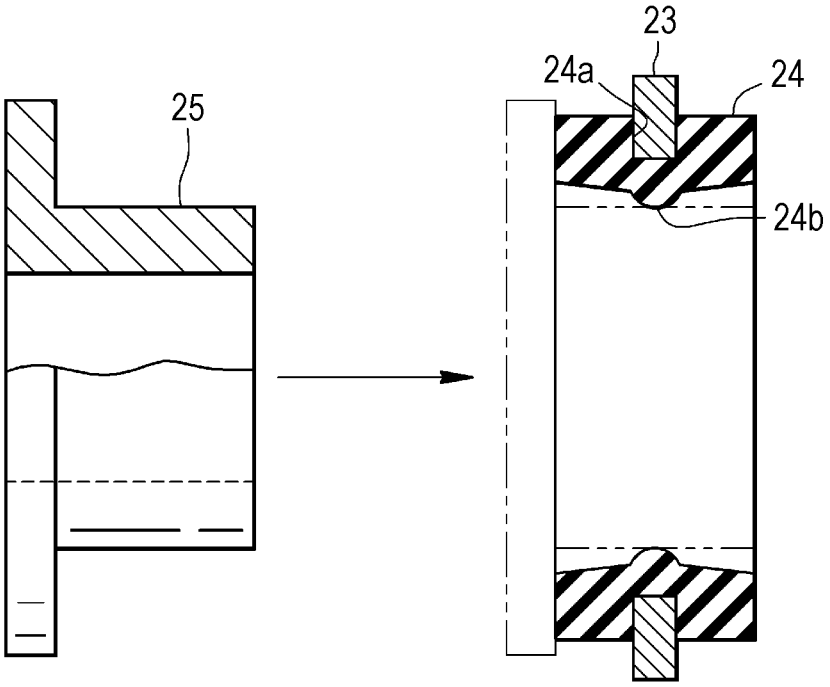
FIG. 6 is an enlarged main-portion sectional view of a stay.

A through-hole 23*a* is provided at the other end of the stay 23. As illustrated in FIGS. 3A and 3B and FIG. 6, a cylindrical elastic member (e.g., a rubber bush) 24 is assembled onto the through-hole 23*a*. The cylindrical elastic member 24 is longer than the plate thickness of the stay 23 with respect to the direction of its axis. A circumferential groove 24*a* is defined in the outer circumferential face of the cylindrical elastic member 24. The circumferential groove 24*a* fits in the outer circumferential portion of the through-hole 23*a* of the stay 23, thereby integrally assembling the elastic member 24 onto the stay 23.

The inner circumferential face of the cylindrical elastic member 24 is formed in a chevron shape that projects more radially inward in the middle than at the ends in the axial direction. Further, a radial protrusion 24*b* is formed at the top of the chevron over the entire inner circumferential face. A collar 25 coaxially fits in the inner circumferential face of the cylindrical elastic member 24. The collar 25 is formed in the shape of a flanged cylinder with a large diameter. The collar 25 is screwed onto the outer wall of the cylinder head 2*a* with a securing bolt 26 inserted from the flange side. The outside diameter of the body of the collar 25 may be the same as the inside diameter of the radial protrusion 24*b*.

The joint member 14 is mounted on the cylinder group 3 side, in such a way that the direction of the axis of the cylinders of the cylinder group 3 ("Cv" in FIG. 3B), and the outflow direction Y of fuel from the joint member 14 in the connecting pipe 15 connected to the delivery pipe 17 on the first cylinder group 3 side are the same. As a result, the outflow direction becomes the same as the direction of thermal expansion or vibration of the outer wall (the portion where the cylinder bank 1*a* is formed) of the first cylinder group 3 on which the joint member 14 is mounted, thereby reducing the amplitude of stress exerted on the connecting pipe 15.

As mentioned above, the stay 23 is mounted on the engine 1 via the elastic member 24, and thus the joint member 14 is elastically supported. As a result, transmission of vibration from the first cylinder group 3 side is reduced, thereby reducing the amplitude of stress exerted on the joint member 14.

While the pipes 12, 15, 16 may be formed by the same pipe material, the outside diameter D2 of the connecting pipes 15, 16 is smaller than the outside diameter D1 of the fuel supply pipe 12 (D2<D1). As a result, for example, the bending strength of the connecting pipes 15, 16 is lower than that of the fuel supply pipe 12. Therefore, the connecting pipes 15, 16 are elastically deformed more easily than the fuel supply pipe 12. Also, the wall thickness t2 of the connecting pipes 15, 16 is preferably smaller than the wall thickness t1 of the fuel supply pipe 12 (t2<t1). Since the connecting pipes 15, 16 are located closer to the fuel injection valves 19 than the fuel supply pipe 12, vibration caused by fuel injection exerts large impact on the connecting pipes 15, 16. This vibration can be absorbed by elastic deformation, thereby reducing the amplitude of stress on the connecting pipes 15, 16 due to vibration.

The outflow direction Z of fuel from the joint member 14 in the connecting pipe 16 connected to the delivery pipe 18 on the second cylinder group 4 side on which the joint member 14 is not mounted intersects the axial direction Cv of the cylinders of the first cylinder group 3 on which the joint member 14 is mounted. As a result, the outflow directions Y, Z of fuel with respect to the first cylinder group 3 on which the joint member 14 is mounted, and the other second cylinder group 4 (on which the joint member 14 is not mounted) intersect one another. Therefore, there is no interference between the direction (Cv) of thermal expansion or vibration of the outer wall of the first cylinder group 3 on which the joint member 14 is mounted, and the direction of pressure pulsation occurring in the outflow direction Z of fuel to the second cylinder group 4, thereby improving the reduction of the amplitude of stress on the connecting pipe 16. Further, the outflow directions Y, Z of fuel to the respective connecting pipes 15, 16 also intersect the inflow direction X of fuel from the fuel injection pipe 12, thereby further improving the reduction of the amplitude of stress on the connecting pipe 16.

Figure 7A:
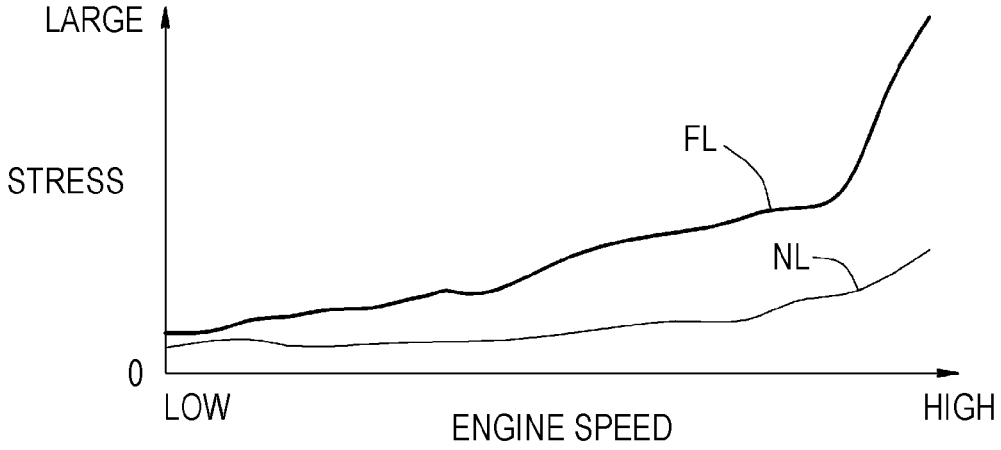
BACKGROUND ART FIG. 7A
Figure 7B:
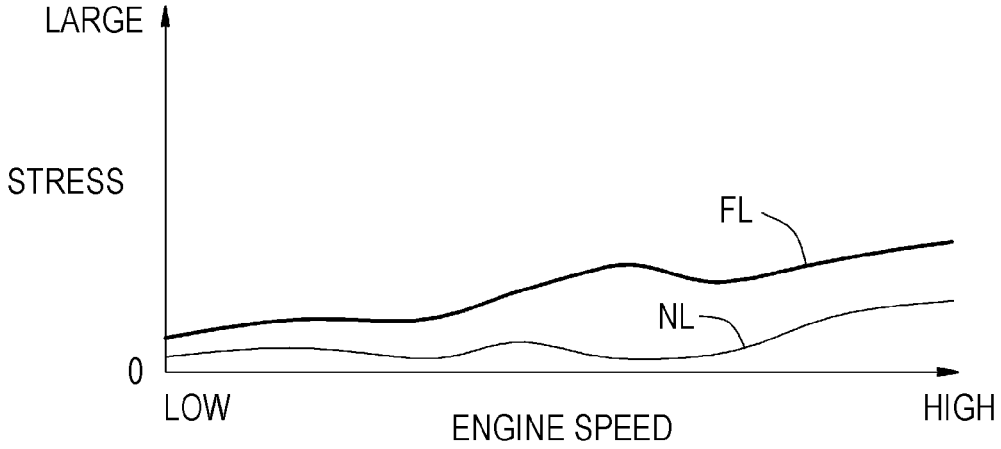

FIGS. 7A and 7B each illustrate variation of stress due to vibrational amplitude which is generated by rotation of the engine, in the connecting pipe 16 on the second cylinder group 4 side on which the joint member 14 according to the above embodiment is not mounted. FIG. 7A illustrates related art in which the branch portion has a T-shaped configuration, and FIG. 7B illustrates the branch portion according to the present application. The horizontal axis represents engine speed, and the vertical axis represents stress.

AS illustrated in FIGS. 7A and 7B, in the case of a T-shaped branch portion, although the stress is not so large at low rotational speeds, the stress increases as the rotational speed becomes higher, and increases sharply as the rotational speed approaches the maximum speed. On the contrary, according to the present application, the stress variations are generally small and flat across the entire low-to-high rotational speed range. As described above, stress is significantly reduced, and damage to the delivery pipes 17, 18 due to vibration of the connecting pipes 15, 16 is prevented. Therefore, for example, even for cases where vibration control measures would have been required in related art, very extensive vibration control measures are not required, thereby reducing cost.

While the above embodiment is directed to the case of a V-type 6-cylinder engine, the engine to which the present application is applied is limited to neither a 6-cylinder engine nor a V-type engine but may be a horizontally opposed engine. Also, the present application is applicable to a straight multi-cylinder engine. In this case, cylinders divided into each set of multiple cylinders of the cylinder row direction may serve as each cylinder group.

While the embodiment of the present application has been described above, as can be easily appreciated by those skilled in the art, the present application is not limited to the specific embodiment but various modifications are possible without departing from the scope of the present application. Also, not all of the components described above with reference to the embodiment are necessarily indispensable but these components may be selected or removed as appropriate without departing from the scope of the present application. The shape of the joint member 14 is not limited to the hexahedron mentioned above but may be a hexahedron with four or more faces, or may be a sphere.

A fuel supply apparatus for an engine according to the embodiment includes: two cylinder groups (3, 4) each including a plurality of cylinders; a plurality of fuel injection valves (19) that inject fuel to the cylinders of the two cylinder groups; a fuel supply pipe (12) that is connected to a fuel supply source (11, 13); two connecting pipes (15, 16) that are connected to the fuel supply pipe via a branch portion (P1 to P3, 21); and two delivery pipes (17, 18) that are each connected to each of the two connecting pipes, the delivery pipes each delivering fuel to the fuel injection valves of a corresponding one of the cylinder groups. All of inflow and two outflow directions (X, Y, Z) of the fuel in the branch portion do not lie in the same straight line.

According to the above configuration of the embodiment, in the branch portion, all of the inflow direction of fuel from the fuel supply pipe, and the outflow directions of flow to the connecting pipes do not lie on the same straight line. Thus, all of the inflow and two outflow directions of fuel branch off at angles other than 180 degrees. As a result, it is possible to prevent pressure pulsations of fuel occurring in individual pipes from being amplified while propagating along the same straight line, thereby reducing pulsation of pressure with respect to all of the three directions. Also, damage to the delivery pipes due to resonance or the like can be prevented.

In particular, the inflow and two outflow directions of the fuel may be different from each other, and the inflow and two outflow directions of the fuel may be orthogonal to each other. Therefore, the three directions, i.e., the inflow and two outflow directions are made to point in the directions of three axes that are orthogonal to each other. As a result, the branch portion has opposed faces in the portions of the branch portion opposed to these directions, and when a pulsation of pressure occurs in one of the pipes, the pressure pulsation is reduced by the corresponding opposed face. In this way, pressure pulsation can be reduced with respect to three directions, thereby preventing damage to the delivery pipes due to resonance or the like in a favorable manner.

Also, the fuel supply apparatus of the embodiment may further include a joint member (14) that is mounted on an outer wall of one (3) of the two cylinder groups, the branch portion may be provided in the joint member, and in the branch portion, an outflow direction (Y) of the fuel to one (17) of the delivery pipes located on a side where the joint member is mounted may be the same as an axial direction (Cv) of the cylinders of one of the cylinder groups on which the joint member is mounted.

The outer wall of each of the cylinder groups undergoes vibration or thermal expansion with respect to the axial direction of the cylinders on the corresponding cylinder group. At this time, according to the above configuration of the embodiment, the outflow direction of fuel from the joint member to the delivery pipe of the cylinder group on which the joint member is mounted, and the axial direction of the cylinders of the cylinder group on which the joint member is mounted are the same. Therefore, this outflow direction becomes the same as the direction of thermal expansion or vibration of the outer wall of the cylinder group on which the joint member is mounted, thereby reducing the amplitude of stress exerted on the corresponding connecting pipe.

Also, in the branch portion of the embodiment, an outflow direction (Z) of the fuel to one (18) of the delivery pipes located on a side where the joint member is not mounted may intersect the axial direction (Cv) of the cylinders of the one of the cylinder groups on which the joint member is mounted.

According to the above configuration of the embodiment, in the joint member, the respective outflow directions of fuel to the cylinder group on which the joint member is mounted and the other cylinder group (on which the joint member is not mounted) intersect one another. Therefore, there is no interference between the direction of thermal expansion or vibration of the outer wall of the cylinder group on which the joint member is mounted, and the direction of pressure pulsation occurring in the outflow direction of fuel to the other cylinder group, thereby improving the reduction of the amplitude of stress on the connecting pipes. Further, the outflow directions of fuel to the respective connecting pipes also intersect the inflow direction of fuel from the fuel injection pipe, thereby further improving the reduction of the amplitude of stress on the connecting pipes.

Also, the joint member of the embodiment may have an aperture (22) that is provided on a fuel outflow side of a connecting port (P1) to which the fuel supply pipe is connected. According to this configuration of the embodiment, pulsation of the pressure of fuel from the fuel supply pipe can be reduced in a favorable manner.

Also, the connecting pipes of the embodiment may be formed so as to be elastically deformed more easily than the fuel supply pipe. According to this configuration of the embodiment, it is possible to reduce the amplitude of stress exerted on the connecting pipes strongly affected by the vibration of the delivery pipes due to fuel injection.

Also, the joint member of the embodiment may integrally have a stay (23), and the stay may be mounted on the outer wall via an elastic member (24). According to this configuration of the embodiment, the joint member is elastically supported. Therefore, transmission of vibration from the cylinder group side is reduced, thereby reducing the amplitude of stress exerted on the joint member.

Obviously, numerous modifications and variations of the present invention are possible in light of the above teachings. It is therefore to be understood that within the scope of the appended claims, the invention may be practiced otherwise than as specifically described herein.

What is claimed is:

1. A fuel supply apparatus for an engine, comprising:

a first cylinder group including a plurality of cylinders;

a second cylinder group including a plurality of cylinders;

first fuel injection valves to inject fuel to the cylinders of the first cylinder group;

second fuel injection valves to inject fuel to the cylinders of the second cylinder group;

a fuel supply pipe connected to a fuel supply source;

a branch portion connected to the fuel supply pipe and having an inflow direction along which fuel is to flow from the fuel supply pipe into the branch portion, the branch portion having first, second, and third connecting ports formed as channels that extend orthogonally to each other;

a first connecting pipe extending in a first axial direction and connected to the branch portion, the branch portion having a first outflow direction along which fuel is to flow from the branch portion into the first connecting pipe;

a second connecting pipe extending in a second axial direction and connected to the branch portion, the branch portion having a second outflow direction along which fuel is to flow from the branch portion into the second connecting pipe, all of the inflow direction, the first outflow direction, and the second outflow direction being provided not to lie in a same straight line, the first axial direction of the first connecting pipe intersects the axial second direction of the second connecting pipe at the branch portion;

a first delivery pipe connected to the first connecting pipe to deliver fuel via the first fuel injection valves to the cylinders of the first cylinder group; and a second delivery pipe connected to the second connecting pipe to deliver fuel via the second fuel injection valves to the cylinders of the second cylinder group.

2. The fuel supply apparatus for an engine according to claim 1, wherein the inflow direction, the first outflow direction, and the second outflow direction are different from each other.

3. The fuel supply apparatus for an engine according to claim 2, further comprising:

a joint member mounted on an outer wall of the first cylinder group, wherein the branch portion is provided in the joint member, and wherein the first outflow direction is parallel to an axial direction of the cylinders of the first cylinder group.

4. The fuel supply apparatus for an engine according to claim 3, wherein the second outflow direction intersects the axial direction of the cylinders of the first cylinder group.

5. The fuel supply apparatus for an engine according to claim 4, wherein the joint member includes the first connecting port to which the fuel supply pipe is connected, and an aperture provided on a downstream side of the connecting port.

6. The fuel supply apparatus for an engine according to claim 5, wherein the first and second connecting pipes are elastically deformable more easily than the fuel supply pipe.

7. The fuel supply apparatus for an engine according to claim 6, further comprising:

a stay integrally provided with the joint member and mounted on the outer wall of the first cylinder group; and an elastic member provided between the stay and the outer wall of the first cylinder group.

8. The fuel supply apparatus for an engine according to claim 3, wherein the joint member includes the first connecting port to which the fuel supply pipe is connected, and an aperture provided on a downstream side of the connecting port.

9. The fuel supply apparatus for an engine according to claim 1, wherein the inflow direction, the first outflow direction, and the second outflow direction are orthogonal to each other.

10. The fuel supply apparatus for an engine according to claim 9, further comprising:

a joint member mounted on an outer wall of the first cylinder group, wherein the branch portion is provided in the joint member, and wherein the first outflow direction is parallel to an axial direction of the cylinders of the first cylinder group.

11. The fuel supply apparatus for an engine according to claim 10, wherein the second outflow direction intersects the axial direction of the cylinders of the first cylinder group.

12. The fuel supply apparatus for an engine according to claim 11, wherein the joint member includes the first connecting port to which the fuel supply pipe is connected, and an aperture provided on a downstream side of the connecting port.

13. The fuel supply apparatus for an engine according to claim 10, wherein the joint member includes the first connecting port to which the fuel supply pipe is connected, and an aperture provided on a downstream side of the connecting port.

14. The fuel supply apparatus for an engine according to claim 1, further comprising:

a joint member mounted on an outer wall of the first cylinder group, wherein the branch portion is provided in the joint member, and wherein the first outflow direction is parallel to an axial direction of the cylinders of the first cylinder group.

15. The fuel supply apparatus for an engine according to claim 14, wherein the second outflow direction intersects the axial direction of the cylinders of the first cylinder group.

16. The fuel supply apparatus for an engine according to claim 15, wherein the joint member includes the first connecting port to which the fuel supply pipe is connected, and an aperture provided on a downstream side of the connecting port.

17. The fuel supply apparatus for an engine according to claim 14, wherein the joint member includes the first connecting port to which the fuel supply pipe is connected, and an aperture provided on a downstream side of the connecting port.

18. The fuel supply apparatus for an engine according to claim 14, further comprising:

a stay integrally provided with the joint member and mounted on the outer wall of the first cylinder group; and an elastic member provided between the stay and the outer wall of the first cylinder group.

19. The fuel supply apparatus for an engine according to claim 1, wherein the first and second connecting pipes are elastically deformable more easily than the fuel supply pipe.

20. The fuel supply apparatus for an engine according to claim 1, wherein the fuel supply pipe is connected to the branch portion via the first connecting port, the first connecting pipe is connected to the branch portion via the second connecting port, and the second connecting pipe is connected to the branch portion via the third connecting port.

* * * * *